US006361621B1

(12) United States Patent
Fortunati et al.

(10) Patent No.: US 6,361,621 B1
(45) Date of Patent: Mar. 26, 2002

(54) PROCESS FOR THE INHIBITION CONTROL IN THE PRODUCTION OF GRAIN-ORIENTED ELECTRICAL SHEETS

(75) Inventors: Stefano Fortunati, Ardea; Stefano Cicale', Rome; Giuseppe Abbruzzese, Montecastrilli, all of (IT)

(73) Assignee: Acciai Speciali Terni S.p.A., Terni (IT)

( * ) Notice: Subject to any disclaimer, the term of this patent is extended or adjusted under 35 U.S.C. 154(b) by 0 days.

(21) Appl. No.: 09/381,105

(22) PCT Filed: Jul. 28, 1997

(86) PCT No.: PCT/EP97/04089

§ 371 Date: Dec. 9, 1999

§ 102(e) Date: Dec. 9, 1999

(87) PCT Pub. No.: WO98/41660

PCT Pub. Date: Sep. 24, 1998

(30) Foreign Application Priority Data

Mar. 14, 1997 (IT) ..... RM97A0147

(51) Int. Cl.[7] ..... H01F 1/04; C21D 8/12

(52) U.S. Cl. ..... 148/113; 148/111; 148/221; 148/230; 148/231

(58) Field of Search ..... 148/221, 230, 148/231, 111, 113

(56) References Cited

U.S. PATENT DOCUMENTS

| | | | | |
|---|---|---|---|---|
| 4,225,366 A | | 9/1980 | Harase et al. | 148/111 |
| 5,266,129 A | * | 11/1993 | Minakuchi et al. | 148/113 |
| 5,472,521 A | * | 12/1995 | Yoshitomi et al. | 148/111 |
| 5,507,883 A | * | 4/1996 | Tanaka et al. | 148/113 |
| 5,512,110 A | * | 4/1996 | Yoshitomi et al. | 148/113 |
| 5,597,424 A | * | 1/1997 | Yoshitomi et al. | 148/111 |
| 5,643,370 A | * | 7/1997 | Huppi | 148/111 |
| 5,679,178 A | * | 10/1997 | Komatsubara et al. | 148/113 |
| 5,759,293 A | * | 6/1998 | Takahashi et al. | 148/111 |
| 5,759,294 A | * | 6/1998 | Bolling et al. | 148/111 |
| 5,800,633 A | * | 9/1998 | Inokuti | 148/111 |
| 5,885,371 A | * | 3/1999 | Komatsubara et al. | 148/113 |

FOREIGN PATENT DOCUMENTS

| | | | |
|---|---|---|---|
| EP | 339474 A | * | 11/1989 |
| EP | 0339474 | | 11/1989 |
| EP | 732413 A | * | 9/1996 |
| WO | 9808987 | | 3/1998 |
| WO | 9810104 | | 3/1998 |
| WO | 9828451 | | 7/1998 |
| WO | 9828452 | | 7/1998 |
| WO | 9828453 | | 7/1998 |

* cited by examiner

*Primary Examiner*—Roy King
*Assistant Examiner*—Nicole Coy
(74) *Attorney, Agent, or Firm*—Hedman & Costigan, P.C.

(57) ABSTRACT

The production of grain-oriented electrical steel sheets is disclosed wherein grain growth in the steel is inhibited by a method comprising the regulation of the content of sulfur and manganese in the steel strp and the cold rolled strip is continuously nitrided at high temperature.

4 Claims, No Drawings

PROCESS FOR THE INHIBITION CONTROL IN THE PRODUCTION OF GRAIN-ORIENTED ELECTRICAL SHEETS

The present application is the national stage filing of and claims priority to International Application No. PCT/EP97/04089, filed Jul. 28, 1997 and Italian Application Serial No. RM97A000147, filed Mar. 14, 1997.

FIELD OF THE INVENTION

The present invention refers to a process for the inhibition control in the production of grain-oriented electrical sheets and, more precisely, refers to a process by which, through control of manganese, sulphur, aluminium and carbon content, type and quantities of precipitated second phases are determined since the hot-rolled strip, to obtain optimum grain size during the decarburization annealing and some degree of inhibition, thus allowing to carry out a subsequent continuous high-temperature heat treatment in which aluminium as nitride is directly precipitated by diffusing nitrogen along the strip thickness, in order to obtain the second phases ratio necessary to control the grain orientation of the final product.

STATE OF THE ART

Grain-oriented silicon steels for magnetic uses are normally classified into two groups, essentially differentiated by the induction value induced by a magnetic field of 800 As/m and know as "B800": the conventional grain-oriented group, where B800 is lower than 1890 mT, and the high-permeability grain-oriented group, where B800 is higher than 1900 mT. Further subdivisions are depending on the so-called "core-losses", expressed as W/kg.

Conventional grain-oriented steels, used since the 1930's, and grain-super-oriented steel, having a higher permeability and industrially used since the second half of the 1960's, are essentially used to realise cores for electric transformers, the advantages of the super-oriented steel rising from its higher permeability (which allows reductions of core sizes) and from its lower losses, which are energy-saving.

The permeability of the sheets depends on the orientation of the body-centred cubic lattice iron crystals (or grains): one of the grain edges must be parallel to the rolling direction. By using some precipitates (inhibitors, also called "second phases") of suitable sizes and distribution, which reduce grain boundary mobility, during the final static annealing a selective growth of the sole grains having the wanted orientation is obtained; the higher the dissolution temperature of said precipitates into the steel, the higher the ability of limiting the grain growth for higher cold rolling rates, the higher the grain orientation and the better the magnetic characteristics of the final product. Manganese sulphide and/or selenide are the predominant inhibitors in a grain-oriented steel and the process normally provides for a two-step cold-rolling, while precipitates including nitrogen linked to aluminium (referred to as "aluminium nitride" for simplicity purposes) are the predominant inhibitors in a grain-super-oriented steel and the cold-rolling process is normally a one-step one.

Nevertheless, when a grain-oriented sheet or a grain-super-oriented sheet is produced, during the solidification of steel and the cooling of the solidified body, second phases allowing the above mentioned improving effect are precipitated in coarse form, useless for the wanted purposes; said second phases must be therefore dissolved, reprecipitated in the right form and maintained into said form until the grain having wanted sizes and orientation is obtained at the end of a complicated and expensive transformation process including a cold-rolling at the desired final thickness, a decarburization annealing and a final annealing.

It is evident that the production problems, linked essentially to the difficulties of obtaining high yields and constant quality, are mainly due to the precautions to be taken during the whole transformation process of the steel for maintaining the second phases (and, in particular, the aluminium nitride) in the wanted form and distribution.

In order to relieve said problems, technics have been developed where, for getting a free growing of the grain during the decarburization step. no sulphides are used as inhibitors and an alloy with a high Mn/S ratio is provided, avoiding therefore thin precipitates in the hot-rolled strip. The aluminium nitride suitable to control the grain growing is obtained by nitriding the strip, preferably after cold-rolling, as it is disclosed, for example, by U.S. Pat. No. 4,225,366 and by European patent n. 0.339.474.

According to the last mentioned patent the aluminium nitride, coarsely precipitated during the slow steel solidification, is maintained into said state by using low slab-heating temperatures (lower than 1280° C., preferably lower than 1250° C.) before the hot-rolling. Nitrogen is introduced after the decarburization annealing, which reacts immediately to produce (essentially near the strip surface) silicon or manganese/silicon nitrides having comparatively low solution temperature, which are dissolved during the final annealing in box-annealing furnaces; the nitrogen so released diffuses into the sheet, reacts with the aluminium and precipitates again on the whole strip thickness in a thin and homogeneous form as mixed aluminium and silicon nitrides; said process involves that the material stays at 700–800° C. for at least four hours. The above patent states that nitrogen must be introduced at a temperature near the decarburization one (about 850° C.) and in any case no higher than 900° C. to avoid an uncontrolled grain growth due to the absence of suitable inhibitors. In fact, the optimum nitriding temperature should be of about 750° C., while 850° C. is the upper limit to avoid said uncontrolled growth.

Prima facie the above process has some advantages: relatively low slab-heating temperatures before hot-rolling, decarburization and nitriding, and the fact that no increase in production costs is due to the necessity to maintain the strip at 700–850° C. for at least four hours in the box-annealing furnace (to obtain the mix of aluminium and silicon nitrides required to control the grain growth), as the heating in the box-annealing furnaces in any case requires similar times.

However, together with the above mentioned advantages the above process has some disadvantages as: (i) the selected composition and the low slab-heating temperature involve that the sheet includes practically no precipitates inhibiting the grain growth: all the heating steps of the strip, and in particular those belonging to the decarburization and to the nitriding steps, must be taken at comparatively low and critically controlled temperatures, in that at the above conditions grain boundaries are very mobile involving the risk of an uncontrolled grain growth; (ii) the nitrogen introduced is stopped near the strip surfaces as silicon and manganese/silicon nitrides, which must be dissolved to allow the nitrogen diffusion towards the core of the sheet and its reaction for creating the wanted aluminium nitride: as a consequence, no improvement speeding up the heating time (for example by using another type of continuous furnace instead of box-annealing ones) can be introduced during the final annealing.

Applicants process is disclosed by Applicant's copending U.S. applications Ser. No. 09/243,000, filed Feb. 26, 1999; Ser. No. 09/242,992, filed Feb. 26, 1999; Ser. No. 09/331,273, filed Jun. 17, 1999; Ser. No. 09/331,506, filed Jun. 22, 1999; and Ser. No. 09/331,504, filed Jun. 22, 1999.

The Applicant, knowing the above difficulties, has developed an improved process which is new and involves a considerable inventive step over the prior art, from which it is distinguished with regard to both the theoretical bases and the process characteristics.

Applicant process is disclosed by Applicant's Italian patent Applications n. RM96A000600, RM96A000606, RM96A000903, RM96A000904, RM96A000905.

Said patent Applications clearly set forth that the whole process, and in particular the control of the heating temperatures, can be made less critical if some precipitation of inhibitors suitable to control the grain growth is allowed since the hot-rolling step, thus allowing a best control of the grain sizes during the primary recrystallisation (during the decarburization annealing) and then a deep nitriding of the sheet to directly create aluminium nitride.

DESCRIPTION OF THE INVENTION

In more detail, the process described in said patent applications provides for carrying out said primary recrystallization annealing continuously between 800 and 950° C., in a wet nitrogen-hydrogen atmosphere for a period of time of between 20 and 150 seconds to produce a primary recrystallized strip; continuously nitriding said recrystallized strip at a temperature between 850 and 1050° C., in a wet nitriding atmosphere comprising ammonia at a level of from 1 to 35 standard liters per kg. of strip and from 0.5 to 100 g/m$^3$ of water vapor.

Object of the present invention is to overcome the disadvantages of the production processes already known and to further improve the technology disclosed by the above mentioned Italian patent Applications by disclosing a process for creating and for controlling, since the hot-rolling step, a system of various inhibitors suitable to make less critical most of the production steps (with particular reference to the careful control of the heating temperature) to obtain optimum grain sizes during the primary recrystallisation and a deep penetration of the nitrogen into the strip to directly form aluminium nitride.

According to the present invention, through a suitable combination of contents of manganese and of sulphur it is possible to make easier (according to the innovative technology disclosed by the above mentioned Applicant's Italian patent Applications) the production of silicon steel sheets both of grain-oriented type and of grain super-oriented type.

In particular, according to the invention, by shifting the content of manganese, though within the limits already known in the 400–1500 ppm range, and by controlling the ratio between the per-cent contents of manganese and of sulphur between 2 and 30 for sulphur contents not higher than 300 ppm, it is possible to obtain since the hot-rolled strip thin precipitates, and in particular precipitates including nitrogen linked to aluminium and a mix of nitrides of manganese and of other elements, like copper, apt to give to the sheet an effective inhibition (Iz) suitable to control the grain growth speed and included between about 400 and about 1300 cm$^{-1}$.

The effective inhibition is calculated through the empirical formula:

$$Iz=1.91\ Fv/r$$

where Fv is the volume fraction of useful precipitates and r is the mean radius of said precipitates.

The inhibition levels so generated are such as to allow, together with the assumed process parameters, a continuous and controlled grain growth before the secondary recrystallisation.

Preferably, the manganese content is controlled in the 500–1000 ppm range.

In addition, the ratio between the weight per-cent contents of manganese and of sulphur is preferably maintained between 2 and 10.

The steel can include some impurities, in particular chromium, nickel and molybdenum, whose total weight per-cent content should be preferably lower than 0.35%.

Still according to the invention, the continuously cast slabs are heated between 1100° C. and 1300° C., preferably between 1150° C. and 1250° C., and hot-rolled with an initial rolling temperature of between 1000° C. and 1150° C., a final rolling temperature of between 900° C. and 1000° C. and a coiling temperature of between 550° C. and 720° C.

Then, the strip is cold-rolled at the desired final thickness and undergoes a primary recrystallisation annealing at 850–900° C. and a nitriding, normally at 900–1050° C.

The reduced content of free manganese in solid solution, characterising the composition of the present invention, allows nitrogen, added to the strip by high-temperature nitriding, to diffuse towards the strip core and to precipitate directly the aluminium included into the matrix. In addition, the precipitate's analysis made after the nitriding step shows that the nitrogen added to the strip precipitates as aluminium nitrides on existing, homogeneously distributed thin sulphides, which act therefore as activators and regulators of the added inhibition.

The strip, coated with MgO-based annealing separators and coiled, is box-annealed by heating it up to 1210° C. under a nitrogen/hydrogen atmosphere and keeping it for at least 10 hours at said temperature under an hydrogen atmosphere.

The present invention will be now disclosed through some embodiments.

EXAMPLE #I

A steel including Si 3.15% by weight, C 230 ppm, Mn 650 ppm, S 140 ppm, $Al_S$ 320 ppm, N 82 ppm, Cu 1000 ppm, Sn 530 ppm, Cr 200 ppm, Mo 100 ppm, Ni 400 ppm, Ti 20 ppm, P 100 ppm has been continuously cast and the slabs have been heated up to 1150° C. and hot-rolled to a thickness of 2.2 mm with an initial rolling temperature of 1055° C. and a final rolling temperature of 915° C. to have an effective inhibition of about 700 cm $^{-1}$. The strips have been then cold-rolled up to thicknesses of 0.22, 0.26 and 0.29 mm. The cold-rolled strips have been continuously annealed at 880° C. for about 120 seconds under a nitrogen/hydrogen atmosphere with a dew-point of 68° C. and immediately after they have been continuously annealed at 960° C. for about 15 seconds under a nitrogen/hydrogen atmosphere with a dew-point of 10° C., adding ammonia at the furnace input to increase of 20–50 ppm the nitrogen content of the strips.

The annealed strips, coated with MgO-based annealing separators and coiled, have been box-annealed according to the following cycle: fast heating up to 700° C., 15 hours pause at said temperature, heating at 40° C./h up to 1200° C., 10 hours pause at said temperature, free cooling.

Magnetic characteristics of said strips are:

TABLE #1

| thickness (mm) | B800 (mT) | P17 (W/kg) |
|---|---|---|
| 0.29 | 1935 | 0.94 |
| 0.26 | 1930 | 0.92 |
| 0.22 | 1940 | 0.85 |

EXAMPLE #2

Castings having the following compositions have been manufactured:

TABLE #2

| Casting | Si % | C ppm | Mn ppm | S ppm | Cu ppm | $Al_s$ ppm | N ppm | Ti ppm |
|---|---|---|---|---|---|---|---|---|
| A | 3.2 | 280 | 1700 | 200 | 1500 | 260 | 80 | 20 |
| B | 3.2 | 200 | 1000 | 350 | 1500 | 290 | 70 | 10 |
| C | 3.1 | 580 | 750 | 190 | 2300 | 310 | 80 | 10 |
| D | 3.2 | 300 | 600 | 230 | 1000 | 300 | 90 | 10 |
| E | 2.9 | 450 | 1000 | 100 | 2000 | 280 | 70 | 20 |
| F | 3.0 | 320 | 1000 | 120 | 1200 | 190 | 90 | 20 |
| G | 3.2 | 50 | 800 | 70 | 1000 | 300 | 80 | 20 |

Slabs have been heated up to 1150° C., bloomed down to a 40 mm thickness and then hot-rolled to a thickness of 2.2–2.3 mm. The hot-rolled strips have been cold-rolled to a thickness of 0.30 mm, decarburized at 870° C. and then nitrided at 930° C. for 30 seconds under a nitrogen/hydrogen atmosphere with a dew-point of 10° C., adding 8% by weight of ammonia at the furnace input. The nitrided strips have been coated with MgO-based annealing separators and box-annealed according to the following cycle: fast heating up to 700° C., 10 hours pause at said temperature, heating at 40° C./h up to 1210° C. under a nitrogen/hydrogen atmosphere, 15 hours pause at said temperature under a hydrogen atmosphere and cooling.

Magnetic characteristics of said strips are shown by Table #3.

TABLE #3

| Casting | A | B | C | D | E | F | G |
|---|---|---|---|---|---|---|---|
| B800 (mT) | 1714 | 1637 | 1935 | 1930 | 1940 | 1841 | 1830 |
| P17 (W/kg) | 1.79 | 2.08 | 0.95 | 0.95 | 0.92 | 1.25 | 1.34 |
| P15 (W/kg) | 1.17 | 1.33 | 0.71 | 0.70 | 0.67 | 0.85 | 0.92 |

EXAMPLE #3

From a casting including iron, Si 3.3% by weight. C 350 ppm, $Al_S$ 290 ppm, N 70 ppm, Mn 650 ppm, S 180 ppm, Cu 1400 ppm and minor impurities, slabs have been produced: some slabs have been treated at 1320° C. (RA) and the rest at 1190° C. (RB) before being hot-rolled to a thickness of 2.2 mm. The strips have been annealed at 900° C. and cooled by water and vapour from 780° C. By analysing the mean content of inhibition into the matrix of hot-rolled annealed strips, for strips RA a value of about 1400 $cm^{-1}$ have been found, while for strips RB a value of about 800 $cm^{-1}$ have been found.

Then, the hot-rolled strips have been cold-rolled to a thickness of 0.27 mm, annealed for primary recristallization at 850° C. and nitrided at 970° C. The nitrided cold-rolled strips have been box-annealed for secondary recrystallisation according to the following cycle: heating at 40° C./h from 700° C. to 1200° C. under a nitrogen/hydrogen atmosphere, 20 hours pause at 1200° C. under a hydrogen atmosphere and cooling.

Magnetic characteristics of said strips are shown by Table #4.

TABLE #4

| SHEET | M800 (mean) | P17 (mean) |
|---|---|---|
| 1 (RB) | 1920 | 0.97 |
| 2 (RB) | 1930 | 0.95 |
| 3 (RB) | 1930 | 0.96 |
| 4 (RA) | 1820 | 1.34 |
| 5 (RA) | 1770 | 1.45 |
| 6 (RA) | 1790 | 1.38 |

Furthermore, losses of strips realised from low-temperature annealed slabs are very constant, while those realised from high-temperature annealed slabs are very unsteady and oscillate cyclically between 1.00 and 1.84 W/kg.

What is claimed is:

1. In the production of grain-oriented electrical steel strips in slabs containing manganese and sulfur from which a hot-rolled strip is produced by hot-rolling, cold-rolling said hot rolled strip to obtain a cold-rolled strip, continuously annealing for primary recrystallization annealing and nitriding and then annealing for secondary recrystallization, the improvement comprising combining the following steps:

(i) maintaining the manganese content in the steel at a range of 400–1500 ppm, controlling the ratio of the manganese to sulfur between 2 and 30 and maintaining the total sulfur content at a level not higher than 300 ppm;

(ii) controlling the slab heating temperature at a temperature of between 1100–1300° C.;

(iii) controlling the hot rolling conditions at an initial rolling temperature of between 1000° C. and 1150° C., the final rolling temperature being between 900° C. and 1000° C. and the coiling temperature being between 550° C. and 720° C. to obtain in the hot-rolled strips thin precipitates to impart to the hot-rolled strip an effective inhibition level (Iz) in the range of between about 400 and 1300 $cm^{-1}$, defined by the formula $$Iz=1.91\ Fv/r$$

wherein Fv is the volume fraction (dimensionless) of said precipitates and r is their mean radius in cm, (iv) carrying out said primary recrystallization annealing continuously between 800 and 950° C., in a wet nitrogen-hydrogen atmosphere for a period of time between 20 and 150 seconds to produce a primary recrystallized strip; and then continuously nitriding said primary recrystallized strip at a temperature between 850 and 1050° C., in a wet nitriding atmosphere comprising ammonia at a level of from 1 to 35 standard liters per kg. of strip and from 0.5 to 100 $g/m^3$ of water vapor.

2. A process according to claim 1, wherein the steel composition comprises manganese in the range of from about 500 to about 1000 ppm and sulfur below 300 ppm, the ratio between manganese and sulfur content comprising between 2 and 30.

3. A process according to claim 1, wherein the steel composition comprises chromium, nickel and molybdenum, at a total weight percent content less than 0.35%.

4. A process according to claim 1, wherein said slabs having a temperature between 1150 and 1250° C. are hot-rolled with an initial rolling temperature between 1000 and 1150 C.

* * * * *